US008992035B2

(12) United States Patent
Zhong et al.

(10) Patent No.: US 8,992,035 B2
(45) Date of Patent: Mar. 31, 2015

(54) LIGHTING DEVICE FOR VENTILATING FAN

(71) Applicants: Panasonic Ecology Systems Guangdong Co., Ltd., Foshan, Guangdong (CN); Shenzhen H&T Intelligent Control Co., Ltd., Shenzhen, Guangdong (CN)

(72) Inventors: Shenghui Zhong, Guangdong (CN); Liang Tian, Guangdong (CN); Shouyong Gao, Guangdong (CN); Jian Peng, Guangdong (CN); Haiping Yuan, Guangdong (CN); Yinan Zhao, Guangdong (CN)

(73) Assignees: Panasonic Ecology Systems Guangdong Co., Ltd., Foshan, Guangdong (CN); Shenzhen H&T Intellectual Control Co., Ltd., Shenzhen (CN)

( * ) Notice: Subject to any disclaimer, the term of this patent is extended or adjusted under 35 U.S.C. 154(b) by 17 days.

(21) Appl. No.: 14/017,473

(22) Filed: Sep. 4, 2013

(65) Prior Publication Data

US 2014/0063783 A1 Mar. 6, 2014

(30) Foreign Application Priority Data

Sep. 5, 2012 (CN) ..... 2012 1 0325142

(51) Int. Cl.
*F21V 33/00* (2006.01)

(52) U.S. Cl.
CPC ..... *F21V 33/0096* (2013.01)
USPC ..... 362/96; 362/294; 362/362

(58) Field of Classification Search
CPC ..... F21V 33/0096
USPC ..... 362/96, 373, 294, 364
See application file for complete search history.

(56) References Cited

U.S. PATENT DOCUMENTS

| | | | | |
|---|---|---|---|---|
| 8,723,086 | B2 * | 5/2014 | McMahan | 219/533 |
| 2008/0285271 | A1 * | 11/2008 | Roberge et al. | 362/235 |
| 2010/0009621 | A1 * | 1/2010 | Hsieh | 454/293 |
| 2013/0088855 | A1 * | 4/2013 | Ye et al. | 362/96 |
| 2014/0078718 | A1 * | 3/2014 | Li et al. | 362/96 |

* cited by examiner

*Primary Examiner* — Anabel Ton
(74) *Attorney, Agent, or Firm* — Jackson IPG PLLC

(57) ABSTRACT

A lighting device for a ventilating fan comprising a power pack module and a light-emitting module composed of a lighting louver and a radiator, wherein first positioning lugs projected out of a horizontal projection plane of the power pack module are formed on the top of the power pack module and fixed on the light-emitting module by screws; and a through hole which a cable, used for supplying power for a light-emitting unit, runs through is respectively formed on a side face of the radiator making contact with the power pack module and a side face of the power pack module making contact with the radiator. The lighting device for the ventilating fan further comprises hooks formed on the radiator and a second positioning lug formed on the power pack module, wherein the hooks and the second positioning lug are used for fixing the lighting device on the ventilating fan.

9 Claims, 1 Drawing Sheet

LIGHTING DEVICE FOR VENTILATING FAN

FIELD OF THE INVENTION

The invention relates to a room air conditioner, in particular to a lighting device for a ventilating fan.

BACKGROUND OF THE INVENTION

Keeping room air fresh is an important criterion at home or office. People often use ventilating fans to accelerate the convection of room air and hence ensure the freshness of room air. In general, lighting devices are arranged on the ventilating fans to achieve the indoor lighting. Both the U.S. Pat. No. 5,934,783 and the Chinese patent No. 2007100973966 provide a technical proposal of the ventilating fan or the ventilating fan. Meanwhile, a ventilating fan/light combination is very inconvenient in maintenance, replacement and the like of a lighting device, and hence large waste may be brought.

SUMMARY OF THE INVENTION

The technical problem to be solved by the invention is to overcome the defect of inconvenient replacement and maintenance and provide a lighting device for a ventilating fan, being convenient in maintenance and replacement.

The technical proposal adopted by the invention to solve the technical problem is that: the invention relates to a lighting device for a ventilating fan, which comprises a light-emitting module and a power pack module, wherein the light-emitting module is composed of a lighting louver and a radiator and used for holding a light-emitting unit; the power pack module is used for holding a power supply unit used for supplying DC power for the light-emitting unit; first positioning lugs projected out of a horizontal projection plane of the power pack module are formed on the top of the power pack module; the power pack module is fixedly connected to the light-emitting module through the first positioning lugs and a screw hole formed on the top surface of the radiator; a through hole which a cable, used for supplying power for the light-emitting unit, runs through is respectively formed at corresponding positions on a side face of the radiator making contact with the power pack module and a side face of the power pack module making contact with the radiator; the lighting device further comprises hooks and a second positioning lug; the hooks are formed on a side face of the radiator away from the power pack module; the second positioning lug is formed on a side face of the power pack module away from the light-emitting module; the hooks and the second positioning lug are used for fixing the lighting device on a ventilating fan louver; and a lighting louver includes a projection extending towards the rear of the lighting louver and entering the radiator when the lighting louver and the radiator are combined into an enclosed space, and is fixed on the radiator by screws to form the enclosed space for holding the light-emitting unit.

In addition, a part of the radiator making contact with the projection of the lighting louver is also provided with a recess matched with the projection and used for holding the projection.

Moreover, a rubber ring disposed on the top of the projection is also arranged inside the recess.

Furthermore, the light-emitting unit is a light-emitting diode (LED) lamp and mounted on the radiator corresponding to the rear center of the lighting louver.

Furthermore, a circle of projecting ribs used for blocking a connecting gap formed when the lighting louver is put into the radiator and connected therewith and used for mounting, fixing and waterproofing work are formed on the peripheral edge of the lighting louver.

Furthermore, the lighting device for the ventilating fan further comprises a hollow rubber stopper running through the through holes fixed on the side faces of the radiator and the power pack module so that the power supply cable provided by the power pack module can run through a middle through hole of the hollow rubber stopper.

Furthermore, the power pack module includes a power pack body and a back cover which are mounted together to form an enclosed space for holding a power supply circuit board; the first positioning lugs are formed on the top of the power pack body; the second positioning lug is formed on the back cover; a boss projected upwards is formed on an edge of the power pack body connected with the back cover; a groove retracted towards the power pack body is formed under the boss; a tongue projected outwards is formed on an edge of the back cover; and the back cover is embedded into the groove through the tongue so as to be connected to the power pack body.

Furthermore, a hat brim structure used for blocking the position of the power pack body making contact with the radiator and projected towards the radiator is disposed on an edge of the side face of the power pack body making contact with the radiator.

Furthermore, an input terminal used for access to an external AC power supply is arranged on the power pack body; and a triangular baffle used for covering the input terminal and preventing the wrong input of the external AC power supply into the input terminal is arranged on the back cover.

The lighting device for the ventilating fan provided by the invention has the advantage that: as the whole lighting device is composed of a plurality of components and fixed on the ventilating fan through the hooks and the second positioning lug after the combination, the lighting device has a different structure compared to the traditional ventilating fan/light combination, and hence the lighting device is convenient in maintenance and replacement.

DETAILED DESCRIPTION OF THE PREFERRED EMBODIMENTS

Further description is given to the embodiments of the invention with reference to the accompanying drawings.

Figure 1:
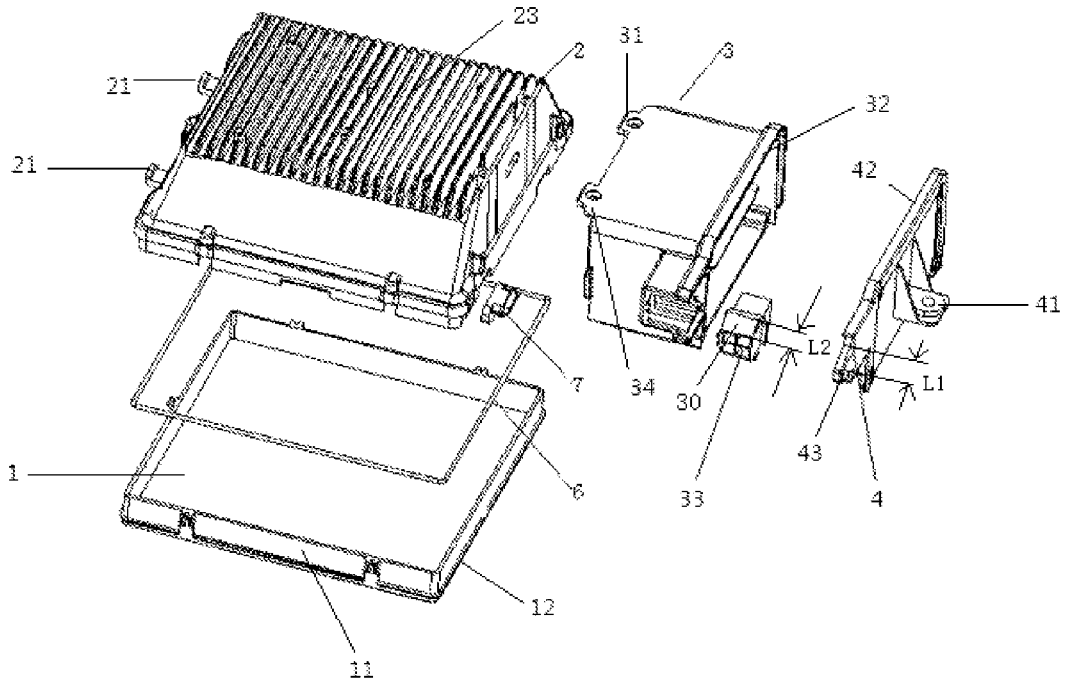
FIG. 1 is a schematic structural view of a lighting device in an embodiment of a lighting device for a ventilating fan provided by the invention.
Figure 2:
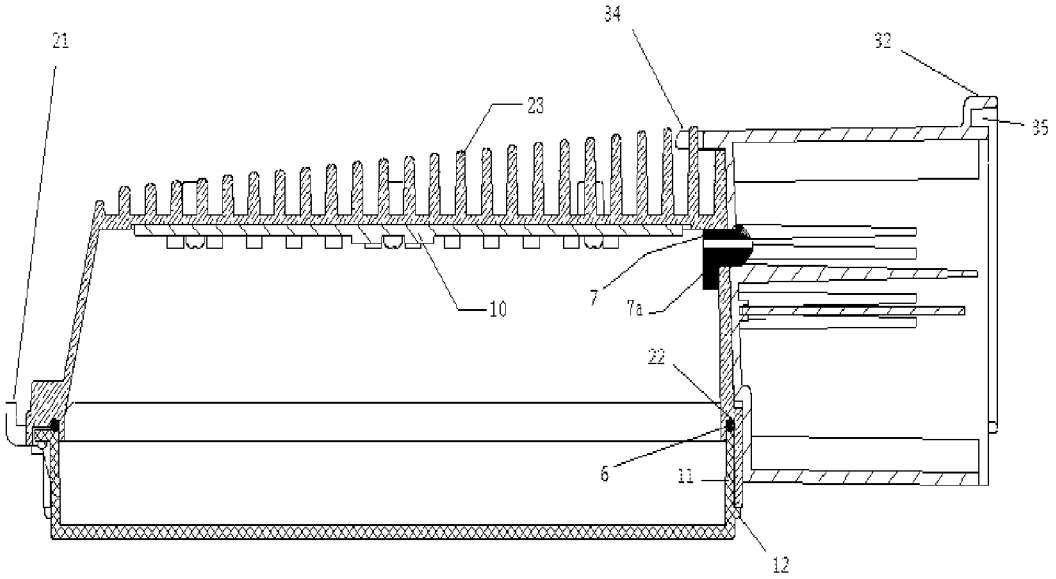
FIG. 2 is a lengthwise sectional view of the lighting device in the embodiment.

As illustrated in FIG. 1, in an embodiment of a lighting device for a ventilating fan provided by the invention, the lighting device comprises a lighting louver 1, a radiator 2, a power pack body 3 and a back cover 4, wherein the lighting louver 1 and the radiator 2 are combined to form a light-emitting module including a light-emitting unit 10 (as illustrated in FIG. 2) arranged inside an enclosed space thereof; the power pack body 3 and the back cover 4 are combined to form a power pack module provided with a power supply unit (not shown in the figure) used for converting an external alternating voltage into a direct voltage and supplying the direct voltage to the light-emitting unit 10 of the lighting device; and the power pack body 3 and the back cover 4 are combined into the power pack module which is hence fixed on the light-emitting module and supplies power for the light-emitting unit 10 through a cable so as to form the lighting device. In the embodiment, the lighting device is independent of the ventilating fan and is fixed at a position, set in advance, on the ventilating fan through a positioning device arranged thereon (namely hooks 21 formed on the radiator 2 and the second positioning lug 41 formed on the back cover 4, as illustrated in FIG. 1), so that a user may use or not use the lighting device in the ventilating fan. Moreover, in the case of the failure of the lighting device, the lighting device can be conveniently removed for maintenance or replacement, so that the lighting device for the ventilating fan has high flexibility.

In the embodiment, the light-emitting module is composed of the lighting louver 1 made of transparent or semi-transparent materials with light transmittance and the radiator 2 which is made of metallic materials and of which the top surface is provided with a plurality of parallel radiating ribs 23, so as to form the enclosed space used for holding the light-emitting unit 10; the power pack module is composed of the power pack body 3 and the back cover 4 to form an enclosed space used for holding the power supply unit (not shown in the figure) used for supplying DC power for the light-emitting unit 10; the power pack module is connected with the light-emitting module through first positioning lugs 31 formed on the top of the power pack module (more specifically, one surface of the power pack body 3 adjacent to the light-emitting module) and projected out of a horizontal projection plane of the power pack module (namely extending to the top surface of the radiator 2 of the light-emitting module when the light-emitting module is connected with the power pack module); and the first positioning lugs 31 of the power pack module are fixed on screw holes formed on the top surface of the radiator 2 by screws, so that the power pack module can be fixedly connected to the light-emitting module to form a complete lighting device. In the embodiment, in order for the power pack module to supply power for the light-emitting unit 10 arranged inside the light-emitting module, a through hole is formed on a side face of the radiator 2 making contact with the power pack module, and a through hole is also formed on a side face of the power pack module (more specifically, the power pack body 3) making contact with the radiator 2. The two through holes correspond to each other in position, namely the two through holes are aligned in position so that the cable used for supplying power for the light-emitting unit 10 can run through conveniently. Moreover, in the embodiment, as the lighting device is independent of the ventilating fan, the lighting device must be fixed in the ventilating fan when mounted together. Therefore, the hooks 21 are formed on a side face of the radiator 2 away from the power pack module, and the second positioning lug 41 is formed on a side face (namely on the back cover 4) of the power pack module away from the light-emitting module. The hooks 21 and the second positioning lug 41 are used for fixing the lighting device, taken as an independent component, on a ventilating fan louver.

As illustrated in FIGS. 1 and 2, in the embodiment, the lighting louver 1 includes a projection 11 extending towards the rear of the lighting louver 1. The projection 11 enters the radiator 2 when the lighting louver 1 and the radiator 2 are combined to form the enclosed space. That is to say, when the lighting louver 1 and the radiator 2 are combined to form the enclosed space, the projection 11 is disposed on the inside of the side wall of the radiator 2 (as illustrated in FIG. 2). In the embodiment, the lighting louver 1 is fixed on the radiator 2 by screws to form the enclosed space used for holding the light-emitting unit 10. Moreover, a recess 22 (as illustrated in FIG. 2) matched with the projection 11 and used for holding the projection 11 is also formed on a part (namely the lower half part of the side wall of the radiator 2) of the radiator 2 making contact with the projection 11 of the lighting louver 1. Furthermore, a rubber ring 6 disposed on the top of the projection 11 (namely the concave bottom of the recess 22) is also arranged inside the recess 22 to effectively prevent water or sulfide gas from entering a lamp body from the front and affecting the service life of an LED lamp.

In the embodiment, the light-emitting unit 10 is an LED lamp and is mounted on the radiator 2 at the rear center of the lighting louver 1; a power supply line is connected to the LED lamp through the through holes; and the LED lamp mounted on the radiator 2 can have good radiating effect, and hence the LED lamp has longer service life. Moreover, in order to prevent outside water from entering the space for holding the light-emitting unit 10, a circle of projecting ribs 12 are also formed on the peripheral edge of the lighting louver 1, as illustrated in FIGS. 1 and 2; and the projecting ribs 12 are used for blocking a connecting gap formed when the lighting louver 1 is put into the radiator 2 and connected therewith. In the embodiment, due to the cooperation of the rubber ring 6, the projection 11, the recess 22 and the projecting ribs 12, not only the lighting louver 1 can be well positioned on the radiator 2 and is convenient in installation but also the connecting gap between the lighting louver 1 and the radiator 2 has good waterproof effect.

The recess 22 is formed on the whole periphery of an opening portion of the radiator 2. As the diameter of the rubber ring 6 is slightly more than the width of the recess 22, when the rubber ring 6 is inserted into the recess 22, the rubber ring 6 can be temporarily fixed even without the lighting louver 1. Therefore, not only the assembly can be improved but also water or sulfide gas can be prevented from entering. Moreover, as the rubber ring 6 is inserted into the recess 22, the rubber ring 6 is not required to have the same square shape with the recess 22.

In the embodiment, in order to achieve better sealing effect and protect the power supply cable provided by the power pack module to the light-emitting module, a hollow rubber stopper 7 (as illustrated in FIG. 2) inserted from the side of the radiator 2 is also disposed inside the two through holes; a through hole running through the lengthwise direction of the hollow rubber stopper 7 is formed at the position of a central axis of the hollow rubber stopper 7; the hollow rubber stopper 7 runs through the two through holes respectively formed on side walls of the radiator 2 and the power pack body 3; and the power supply cable provided by the power pack module runs through the middle through hole of the hollow rubber stopper 7, so as to effectively prevent water or sulfide gas from entering the lamp body from the side and affecting the service life of the LED lamp. More specifically, a cross section at one end of the hollow rubber stopper 7 takes the shape of a slope and includes a bevel edge and a vertical edge (as illustrated in FIG. 2); the bevel edge provides convenience for the hollow rubber stopper 7 to be inserted into the through holes; and after the bevel edge runs through the through holes, due to the vertical edge, the hollow rubber stopper 7 cannot be removed, so that the hollow rubber stopper 7 can be conveniently positioned. Moreover, a baffle 7*a* of which the area is more than the diameter of the through holes is arranged at the other end of the hollow rubber stopper 7, and not only can be used for positioning the hollow rubber stopper 7 so that the hollow rubber stopper 7 cannot run through the through holes completely, but also provides convenience for pulling the hollow rubber stopper 7 when the hollow rubber stopper 7 is removed, so as to take out the hollow rubber stopper 7 from the through holes.

As illustrated in FIGS. 1 and 2, as described above, the power pack module includes the power pack body 3 and the back cover 4 which are mounted together to form the enclosed space used for holding the power supply circuit board (not shown in the figure, a circuit on the circuit board finishes the conversion from the alternating input voltage to the direct output voltage); the first positioning lugs 31 (used for fixedly connecting the power pack module to the light-emitting module) is formed on the top edge of the power pack body 3; when the power pack module is connected with the light-emitting module, the first positioning lugs 31 are extended to the top of the radiator 2 and aligned with the screw holes formed on the top of the radiator 2; and the power pack module and the light-emitting module can be integrally fixed by connecting the first positioning lugs 31 and the radiator 2 through the screws. Moreover, the second positioning lug 41 is formed on the back cover 4; a boss 32 projected upwards is formed on an edge of the power pack body 3 connected with the back cover 4; a groove 35 retracted towards the power pack body 3 is formed under the boss 32; a tongue 42 projected outwards is formed on an edge of the back cover 4; and the back cover 4 is embedded into the groove 35 through the tongue 42 so as to be connected to the power pack body 3. Furthermore, a hat brim structure 34 is disposed on an edge of the side face of the power pack body 3 making contact with the radiator 2 and the radiating ribs 23 and used for blocking the position of the power pack body 3 making contact with the radiator 2. That is to say, the top edge of one surface of the power pack body 3 making contact with the radiator 2 is projected towards the radiator 2 connected therewith and used for blocking the gap formed when the power pack body 3 and the radiator 2 are spliced together and preventing the outside water or other substances from entering the gap from the right astern and hence affecting the cable running through the gap and used for power supply. In the embodiment, the first positioning lugs 31 are also formed on the hat brim structure 34.

The direction of the hat brim structure 34 projected out of the power pack body 3 is perpendicularly intersected with a parallel line of a plurality of the radiating ribs 23. Due to the hat brim structure 34, the heat emitted by the radiating ribs 23 can be blocked.

Moreover, the height of the radiating ribs 23 connected with the hat brim structure 34 is set to be more than that of the other radiating ribs, so that the heat shift towards the power pack body 3 can be conveniently reduced.

Furthermore, an input terminal 33 used for access to an external AC power supply is also arranged on the power pack body 3; an alternating voltage required by the power supply unit is led into a power supply through the input terminal 33 by a plug or a socket; and in order to avoid the power failure caused by the insertion of a wrong plug, a triangular baffle 43 abutting against the input terminal 33 is arranged on the back cover 4. As illustrated in FIG. 1, the surface of the triangular baffle 43 facing the light-emitting unit 10 abuts against one surface of the input terminal 33; and a distance L1 of the triangular baffle 43 projected towards the front direction is more than a distance L2 of a terminal head 30 of the input terminal 33, projected towards the front direction. Therefore, a user only needs to set a first edge (not shown in the figure) of one side of a terminal (not shown in the figure) connected with an input plug (not shown in the figure), making contact with the triangular baffle 43, to be approximately equal to L1-L2 (L1 minus L2) in length, and set a second edge (not shown in the figure) of one side of the terminal (not shown in the figure) connected with the input plug (not shown in the figure), opposite to the triangular baffle 43, to be more than L1-L2 (L1 minus L2) in length. Therefore, when the terminal (not shown in the figure) connected with the input plug (not shown in the figure) is connected with the input terminal 33, in the case of wrong or opposite direction, the second edge (not shown in the figure) is interfered with the triangular baffle 43 so that the input terminal 33 cannot be inserted. Due to the above structure, a guarantee can be made that the input terminal 33 cannot be inserted in the case of wrong plug or opposite plug direction, and hence the damage of the power supply cannot be caused.

Basically, in the embodiment, the lighting device comprises the lighting louver 1, the radiator 2, the power pack body 3, the back cover 4, the hollow rubber stopper 7, the rubber ring 6, the power supply circuit and the light source, wherein the light source (namely the light-emitting unit) is an LED lamp and arranged at the corresponding position of the radiator 2 corresponding to the rear center of the lighting louver 1; and the LED lamp has two modes, namely "main light" and "small nightlight" and can be flexibly selected via switches. The lighting device is mounted at a position, at which a common energy-saving lamp of the ventilating fan is originally mounted, through the hooks 21. The rubber ring 6 achieves the basic waterproof effect. The lighting device has the advantages of long service life of the whole lamp, compact structure, beautility, and convenient installation, achieves the lighting function, meets the requirements of energy conservation and environmental protection, and effectively reduces the integrated cost of house decoration. Moreover, as the front end of the radiator 2 is provided with the hooks 21 and the rear end (namely the second positioning lug 41 formed on the back cover 4) of the radiator 2 can be fixed only by a screw, the radiator 2 can be conveniently and firmly mounted; as the back cover 4 is provided with the triangular baffle 43 used for preventing the wrong insertion of the input terminal 33, the damage of the terminal 33 due to installation error or the possibility of electric shock can be completely eliminated; as the power pack body 3 and the back cover 4 adopt the design of adopting the stepped surface on the outside and the groove and the tongue on the inside, when water falls on a power pack from above, the water flows down steps quickly by utilization of the height difference of the steps, so that the phenomenon that the water enters the power pack can be avoided; even if the water enters the gap of the power pack cover from other angles, the water can also fall into the groove and hence be discharged out of the power pack from the groove; as the power pack body 3 includes the hat brim structure 34 used for covering the connecting position of the power pack body 3 and the radiator 2, when the water falls on the hat brim structure 34 from above, the water can flow into a radiating groove of the radiator 2 and flow out along the radiating groove; as the groove and the recess are formed below the hat brim structure 34 and above the power pack body 3 and the radiator 2 respectively, even if the water flows into the connecting position of the power pack body 3 and the radiator 2 from the side face, the water can flow out along the groove and the recess; as a circle of the projecting ribs are formed on the edge of the lighting louver 1 and used for blocking the connecting gap between the lighting louver 1 and the radiator 2, no water can enter the radiator 2 and affect the normal operation of the light source in the radiator 2 no matter how high the intensity of the water sprayed into the lighting louver 1 from the front; and meanwhile, the ribs are also fasteners mounted on the ventilating fan and have the functions of both fixing and waterproofing. Moreover, due to the adoption of the rubber ring 6 and the hollow rubber stopper 7 formed by thermoplastic polyurethane elastomers made of special materials, the sulfurization of sulfides to the LED can be effectively prevented, and hence the light efficiency and the service life of the LED can be guaranteed and the LED has waterproof function.

The foregoing is only the embodiments of the invention. Although the description is specific and detailed, it should not be construed as the limitation of the scope of the patent of the invention. It should be noted that various deformations and modifications can be also made by those skilled in the art without departing from the concept of the invention and should all fall within the scope of protection of the invention. Therefore, the scope of protection of the patent of the invention should be defined by the attached claims.

What is claimed is:

1. A lighting device for a ventilating fan, comprising a light-emitting module and a power pack module, wherein the light-emitting module composed of a lighting louver and a radiator and used for holding a light-emitting unit; the power pack module used for holding a power supply unit used for supplying DC power for the light-emitting unit; first positioning lugs projected out of a horizontal projection plane of the power pack module formed on the top of the power pack module; the power pack module fixedly connected to the light-emitting module through the first positioning lugs and a screw hole formed on the top surface of the radiator; a through hole which a cable, used for supplying power for the light-emitting unit, runs through respectively formed at corresponding positions on a side face of the radiator making contact with the power pack module and a side face of the power pack module making contact with the radiator; the lighting device further comprising hooks and a second positioning lug; the hooks formed on a side face of the radiator away from the power pack module; the second positioning lug formed on a side face of the power pack module away from the light-emitting module; the hooks and the second positioning lug used for fixing the lighting device on a ventilating fan louver; and a lighting louver including a projection extending towards the rear of the lighting louver and entering the radiator when the lighting louver and the radiator are combined into an enclosed space, and fixed on the radiator by screws to form the enclosed space for holding the light-emitting unit.

2. The lighting device for the ventilating fan according to claim 1, wherein a part of the radiator making contact with the projection of the lighting louver is also provided with a recess matched with the projection and used for holding the projection.

3. The lighting device for the ventilating fan according to claim 2, wherein a rubber ring disposed on the top of the projection is also arranged inside the recess.

4. The lighting device for the ventilating fan according to claim 3, wherein the light-emitting unit is a light-emitting diode (LED) lamp and mounted on the radiator corresponding to the rear center of the lighting louver.

5. The lighting device for the ventilating fan according to claim 4, wherein a circle of projecting ribs used for blocking a connecting gap formed when the lighting louver is put into the radiator and connected therewith and used for mounting, fixing and waterproofing work are formed on the peripheral edge of the lighting louver.

6. The lighting device for the ventilating fan according to claim 5, wherein the lighting device for the ventilating fan further comprises a hollow rubber stopper running through the through holes fixed on the side faces of the radiator and the power pack module so that the power supply cable provided by the power pack module can run through a middle through hole of the hollow rubber stopper.

7. The lighting device for the ventilating fan according to claim 6, wherein the power pack module includes a power pack body and a back cover which are mounted together to form an enclosed space for holding a power supply circuit board; the first positioning lugs are formed on the top of the power pack body; the second positioning lug is formed on the back cover; a boss projected upwards is formed on an edge of the power pack body connected with the back cover; a groove retracted towards the power pack body is formed under the boss; a tongue projected outwards is formed on an edge of the back cover; and the back cover is embedded into the groove through the tongue so as to be connected to the power pack body.

8. The lighting device for the ventilating fan according to claim 7, wherein a hat brim structure used for blocking the position of the power pack body making contact with the radiator and projected towards the radiator is disposed on an edge of the side face of the power pack body making contact with the radiator.

9. The lighting device for the ventilating fan according to claim 8, wherein an input terminal used for access to an external AC power supply is arranged on the power pack body; and a triangular baffle used for covering the input terminal and preventing the wrong input of the external AC power supply into the input terminal is arranged on the back cover.

* * * * *